US008146194B1

(12) United States Patent
Farrell

(10) Patent No.: US 8,146,194 B1
(45) Date of Patent: Apr. 3, 2012

(54) BUFFING APPARATUS

(76) Inventor: James Farrell, Bonita Springs, FL (US)

( * ) Notice: Subject to any disclaimer, the term of this patent is extended or adjusted under 35 U.S.C. 154(b) by 0 days.

(21) Appl. No.: 12/080,849

(22) Filed: Apr. 7, 2008

(51) Int. Cl.
*A47L 11/10* (2006.01)

(52) U.S. Cl. ..... 15/97.1; 15/98; 15/99; 15/102; 15/179; 15/230; 15/50.3; 15/52.1; 15/77; 15/320

(58) Field of Classification Search ..... 15/97.1, 15/102, 97, 77, 99, 98, 50.3, 93.1, 230, 179, 15/52.1, 320; 451/352, 358, 359, 496
See application file for complete search history.

(56) References Cited

U.S. PATENT DOCUMENTS 2,498,205 A * 2/1950 Goldenberg ..... 15/98
2,696,015 A * 12/1954 Richter ..... 15/147.1
3,042,950 A * 7/1962 Ludwig, Jr. et. al. ..... 15/50.3
3,072,940 A * 1/1963 Kelly ..... 15/52.1
3,395,495 A * 8/1968 Powanda ..... 451/358
3,533,120 A * 10/1970 De Mercado ..... 15/50.1
3,551,934 A * 1/1971 Franzreb ..... 15/97.3
3,596,411 A * 8/1971 Hutchins ..... 451/358
3,648,413 A * 3/1972 Godwin et al. ..... 451/358
3,699,607 A * 10/1972 Putt ..... 15/320
5,725,422 A * 3/1998 Leweck ..... 451/359
2002/0129835 A1* 9/2002 Pieroni et al. ..... 134/6
2008/0032603 A1* 2/2008 Manor ..... 451/11
2008/0086828 A1* 4/2008 Major ..... 15/230.11

* cited by examiner

*Primary Examiner* — Robert Scruggs
(74) *Attorney, Agent, or Firm* — Edward M. Livingston, Esq.; Bryan L. Loeffler, Esq.; The Livingston Firm

(57) ABSTRACT

The present invention is a buffer device that is designed and configured to successfully and adequately buff and polish any desired surface without causing fatigue for the user, as well as without creating any swirl marks. In order to provide for such a product, the present invention comprises a frame having a cylindrical body secured thereto. A motor is coupled to the cylindrical body to provide for the body to rotate about a normally horizontal axis that is parallel to the desired surface to be buffed, polished, and cleaned or the like. Secured to the cylindrical body is a buffing/cleaning pad fabricated from a conventional material.

20 Claims, 6 Drawing Sheets

BUFFING APPARATUS

BACKGROUND OF THE INVENTION

1. Field of the Invention

The present invention relates generally to an apparatus designed and configured to adequately and efficiently buff and polish any desired surface, such as, but not limited to natural and synthetic surfaces, such as marble or granite, automobiles, trailers, cars, boats, recreational vehicles, or the like. More particularly, the present invention includes a unique design for a buffing apparatus including a removable pad that ultimately will not create swirl marks on any painted surface, such as automotive paint, marine paint, gel coats, air craft paints or the like as well as preventing swirl marks from natural surfaces, such as marble, granite or the like. Inherently, rendering a device that provides success and ease of usability when buffing and/or polishing a desired surface.

2. Description of the Prior Art

Buffers are known in the art and are used to polish various surfaces, such as, but not limited to automobiles, RVs, boats, trailers and the like. Buffers that are commercially available are generally devices that include a circular pad removably secure thereto. These devices are control by way of a motor. Though some what successful, these devices do suffer from shortcomings.

One common known concern is that use will cause circular swirl marks on the buff surface. To address this concern, various pads have been developed to reduce this problem. Unfortunately, the results are still the same and in addition, most devices do not address the fatigue that can develop when using the specific device. In addition, without changing the structure of the device, the user will still have difficulties reaching high places, even when using a ladder.

Accordingly, it can be seen that there exists a need for device that can successfully buff any desired surface without leaving swirl marks or the like. Such an apparatus should be versatile, compact in size, light in weight and simple in construction so as to provide a device, which is successful, and can easily be used by any individual regardless of age, physical ability or dexterity.

As will be seen, the present invention achieves its intended purposes, objectives and advantages by accomplishing the needs as identified above, through a new, useful and unobvious combination of component elements, which are simple to use, with the utilization of a minimum number of functioning parts, at a reasonable cost to manufacture, assemble, test and by employing only readily available material.

SUMMARY OF THE INVENTION

The present invention is a buffer device that is designed and configured to successfully and adequately buff and polish any desired surface without causing fatigue for the user, as well as without creating any swirl marks. In order to provide for such a product, the present invention comprises a frame. The frame includes a cylindrical body and a motor. Removably secured to the cylindrical body is a buffing pad and the motor controls the rotation of the cylindrical body. For added versatility, the motor includes variable speed control.

The unique feature about the present invention is the cylindrical body is adapted to rotate about a normally horizontal axis that is parallel to the desired surface to be buffed, polished, and cleaned or the like. Hence, the cylindrical body having an annular outer surface. This outer surface centered on and turned radially away from the axis. Secured to the cylindrical body is a buffing/cleaning pad fabricated from a conventional material.

A number of pads can be utilized with the present invention. The purpose of the pads is provide buffing, finishing, polishing or the like. The type of pad is dependent on what the user wishes to accomplish. Thus any type of pad of any material can be removably secured thereto. In addition, for enhancing the present invention, a removably brush can also be provided for enabling deep cleaning capabilities.

Hence, to operate the present invention, the user activates the motor. Once activated, the motor drives the cylindrical body to rotate. This rotational movement enables the buffing pad to clean and/or polish the desired surface. The frame of the present invention allows the user to maintain and hold the device. Thereby providing for the frame to act as a handle.

Protecting the user, a splash guard is provided. This splash guard is rearwardly mounted with respect to the cylindrical body. This will provide for a means of preventing liquid or the like from splashing into the eyes of a user as well as protecting the surface being buffed/polished.

Enhancing the present invention is the use of an extension device. This extension device is removably secured to the frame. Once secured thereto, the device can reach higher levels. This extension device has various heights that it can be adjusted to in order to offer more flexibility in the use of the buffer device. Enhancing the use of the extension device is providing for electrical communication to be achieved between the extension device and the motor. Activation of the motor can be achieved by the use of a switch located on the extension. Thereby easing the usability of the present invention.

A cover, known as a bonnet is removably attached to the cylindrical body. This bonnet is fabricated from a material, which is breathable yet adapted to aid in polishing, sealing, or the like of the various surfaces.

Accordingly, it is the primary object of the present invention to provide for a buffer device that will successfully and effectively allow a user to buff and polish a desired surface without leaving swirl marks and without causing the user to feel fatigue or the like.

Another object of the present invention is to provide for a buffer device that will enable a pad to have an axis of rotation that is parallel to the surface that is being polished.

A further object of the present invention is to provide for a buffer device, which will overcome the deficiencies, shortcomings, and drawbacks of the prior art and methods thereof.

Still a further object of the present invention, to be specifically enumerated herein, is to provide a buffer device in accordance with the preceding objects and which will conform to conventional forms of manufacture, be of simple construction and easy to use so as to provide a device that would be economically feasible, long lasting and relatively trouble free in operation.

Although there have been many buffer devices, these devices still provide for swirl marks to exist by providing the rotation of the pad to occur perpendicularly to the polishing surface. Thus, the foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention taken in conjunction with the accompanying drawings.

BRIEF DESCRIPTION OF THE DRAWING

Similar reference numerals refer to similar parts throughout the several views of the drawings.

DESCRIPTION OF THE PREFERRED EMBODIMENT

Figure 1:
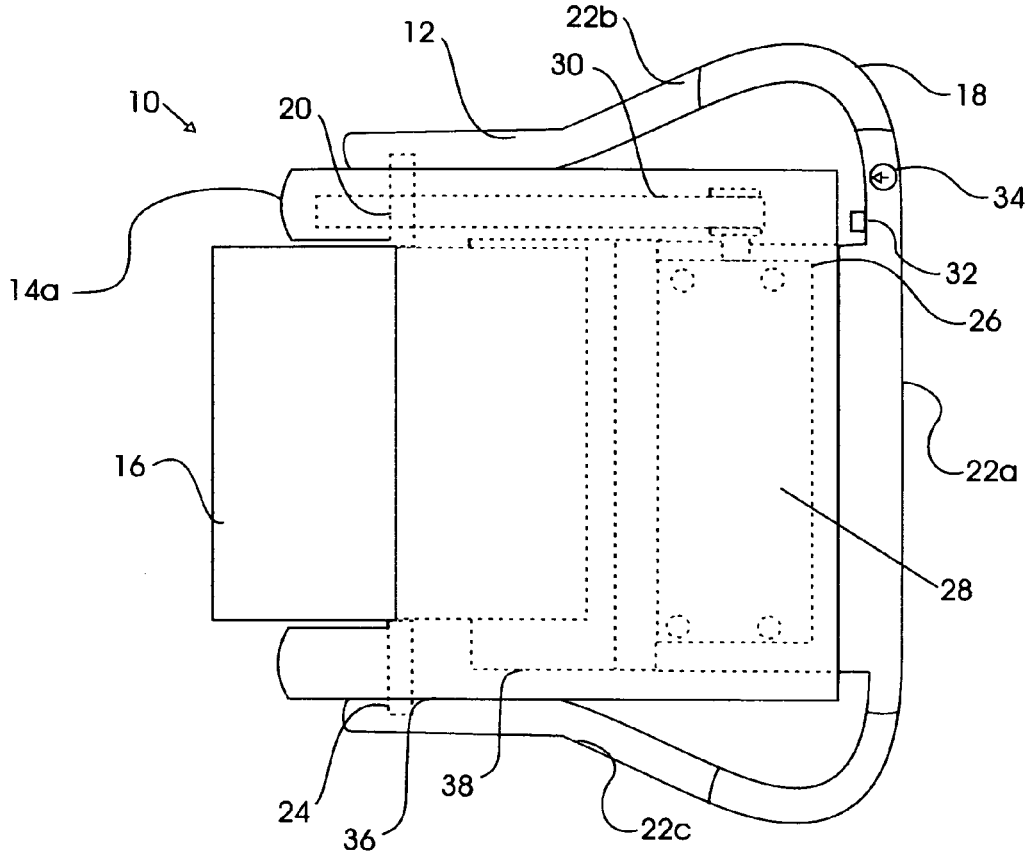
FIG. 1 is a lower planar view of the buffer device of the present invention.
Figure 2:
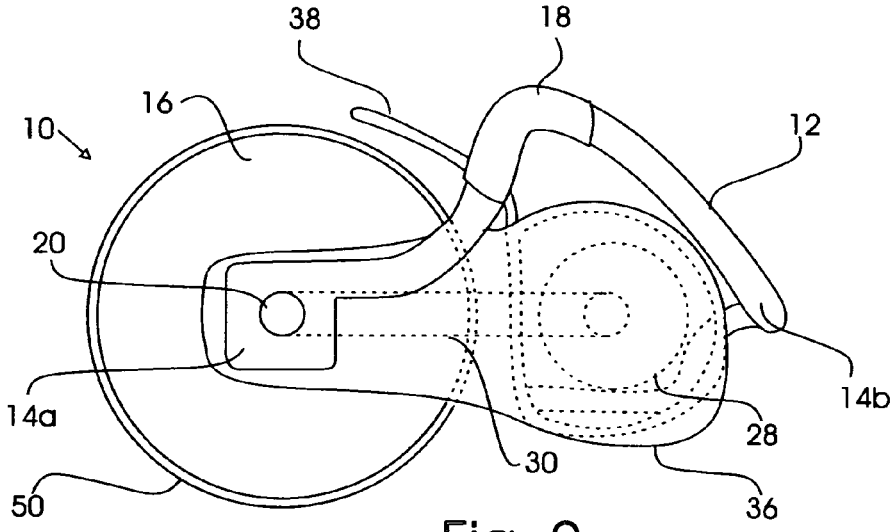
FIG. 2 is a side view of the buffer device of the present invention.

As illustrated in FIGS. 1-2, a buffer device 10 of the present invention is shown. The object of the buffer device 10 of the present invitation is to provide for an apparatus that will successfully and effectively buff and polish a desired surface. In order to do so, the present invention 10 comprises a frame 12 having a front end 14*a* and a rear end 14*b*. Secured to the front end is a cylindrical body 16. The unique feature about the present invention is the cylindrical body 16 is adapted to rotate about a normally horizontal axis parallel to a normal planar direction of the desired surface to be buffed, polished, and cleaned or the like. Hence, the cylindrical body having an annular outer surface. This outer surface centered on and turned radially away from the axis. Secured to the cylindrical body is a buffing/cleaning pad 50 fabricated from a conventional material. The pad 50 will be discussed in further detail in FIGS. 8A-8B. Hence the cylinder rotates horizontally so that the rotation of the surface is parallel to the desired surface. Thereby the axis being parallel to the desired surface to be buffed, polished, and/or cleaned.

Figure 5:
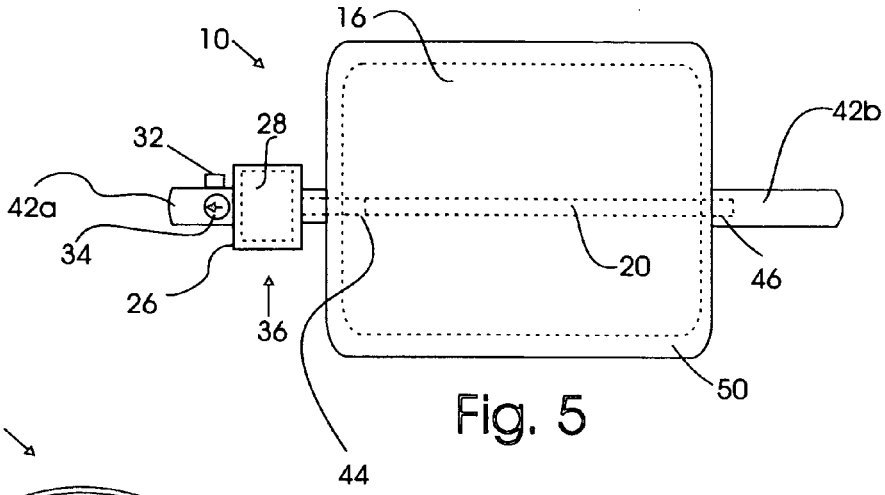
FIG. 5 is a bottom planar view of an alternative configuration for the frame of the buffer device of the present invention.
Figure 6:
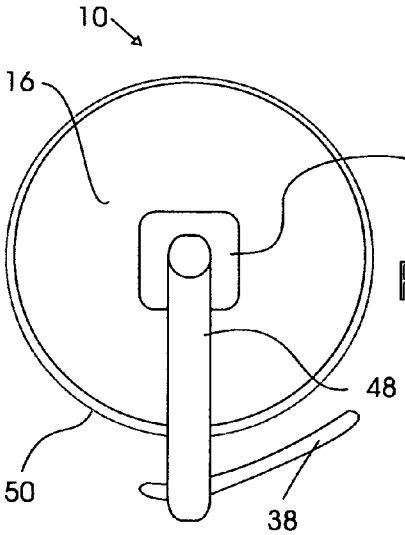
FIG. 6 is a side view of the altered elongated frame of the buffer device of the present invention.

Preferably, the frame includes a substantially U-shape configuration. This configuration allows for a front end, or the open end of the U to include and receive the cylindrical body 16. As illustrate, the rear end 14*b*, or the bottom of the U-shape, is ideally suited for the user's hands or the like. Thus providing for the rear end 14*b* to be the handle portion of the frame. For added comfort, a foam padding 18 or the like can be located on this end. It is noted that the shape of the frame is a design element and thus can include any configuration that is deemed to be ergonomically feasible and useable for the user. For example, as illustrated in FIGS. 1-2, the frame member is substantially U-shape with the lower end be substantially enlarged. As seen in FIGS. 5-6, the U-shape designed has been replaced with a linear configuration for the handle, inherently, and as shown making this a hand held unit.

Figure 3:
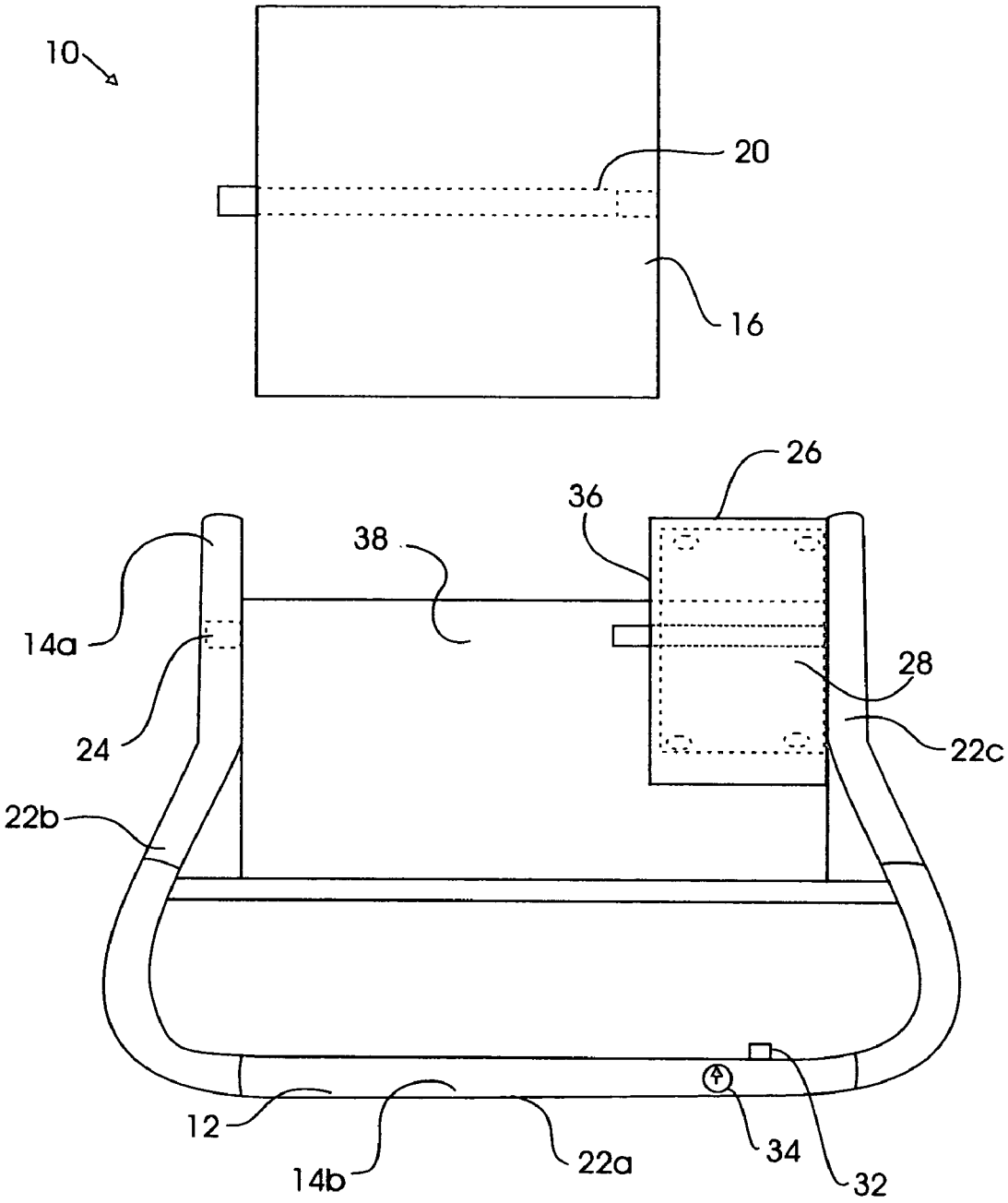
FIG. 3 is an exploded view of an alternative configuration for the frame and the location of the motor unit used in the buffer device of the present invention.

Extending through the cylindrical body 16, as seen in FIG. 1, is an axle 20. The cylindrical body rotates about this axle. The ends of the axle 20 extend outwardly from the cylindrical body, as shown. The ends of the axle will be received within the frame. In this configuration, the ends can be removably secured to the frame. This will allow for the user to freely remove the cylinder 16 when desired. An example of the cylinder being removed is shown in FIG. 3.

As seen in FIGS. 1-2, the U-shape configuration provides for a first lower member 22*a* and outer member 22*b* and 22*c*, respectfully. This lower member 22*a* includes outer extending portions that consequently provide for a comfortable fit for the user. This area can includes foam padding 18, for added comfort. Located on the inner side of each outer parallel member is a receiving port 24. The receiving ports 24 will receive the axle of the cylinder body 16.

Activation of the cylindrical body member occurs by way of a motor unit 26. It is noted that the motor unit can be located on any area of the frame 12. Thereby the motor unit can be located next to or behind the cylindrical body 16. As seen in FIGS. 1 and 2, the motor unit is located behind the buffer and along the end 14*b* of the frame 12. In this configuration a motor unit 26 includes a motor 28 and coupling means 30. The coupling means enables the buffer to rotate once the motor is active. As seen the coupling means includes a drive shaft that is mechanically coupled to the axle 20 of the cylinder body 16 once it is located within the receiving port 24. As seen in the drawings the coupling means is conventional, and as shown is a belt assembly. Thereby providing for the belt assembly to travel from the drive shaft of the motor to the axle of the cylindrical body. Thus, upon activation of the motor, the drive shaft will rotate. Inherently causing the belt to move forcing the rotation of the cylinder via the axle. Rotation occurring in a horizontal configuration that is parallel to a planar or desired surface.

Coupling the motor to the cylindrical body allows for it to rotate. The axis of rotation of the pad is such that it is parallel to the surface. Rotation occurs about a normally horizontal axis parallel to a normal direction of the desired surface to be buffed, polished, and cleaned or the like. This configuration has proven to be favorable and has shown to eliminate swirl marks of a particular surface that is being treated with the present invention. Swirl marks being the result of a circular rotation of conventional buffing devices.

To activate the motor unit 26, a switch 32 is located on the handle. Enhancing the product, the motor unit can include variable speeds. The speeds can be control via the switch 32 or optionally a variable dial 34 can be used to control the speed of the motor. In the preferred embodiment, the switch can be activated via a push button or a mechanical on/off switch. The user depresses down once for activation, or moves to the desired position (on or off). The user can utilize the dial for determining the speed desired. The speed for the rotation of the cylinder can vary from a slow to fast mode, to as many as modes as possible. It is noted that ten speeds have been utilized to produce favorable results. Verbiage can be located on or near the switch/speed control for indicating its use and purpose. It is to be understood that the designed and configuration of the buttons, switch, dial and verbiage or designed can be altered and changed for aesthetic purposes.

Enhancing the present invention, a cover or protective housing 36 is used to protect the motor unit 26 from the elements, foreign objects or the like. Using a cover also protects the user from injury or the like.

Additional features can also be added for added comfort and protection from the user. Located on the housing and extending upwardly there from is a splash guard 38. The purpose of the splashguard is to protect the user from the liquid that can splash during the use of the buffer device. In addition, the shield 38 will protect the area being clean, by preventing solution or the like to fall thereon.

Figure 4:
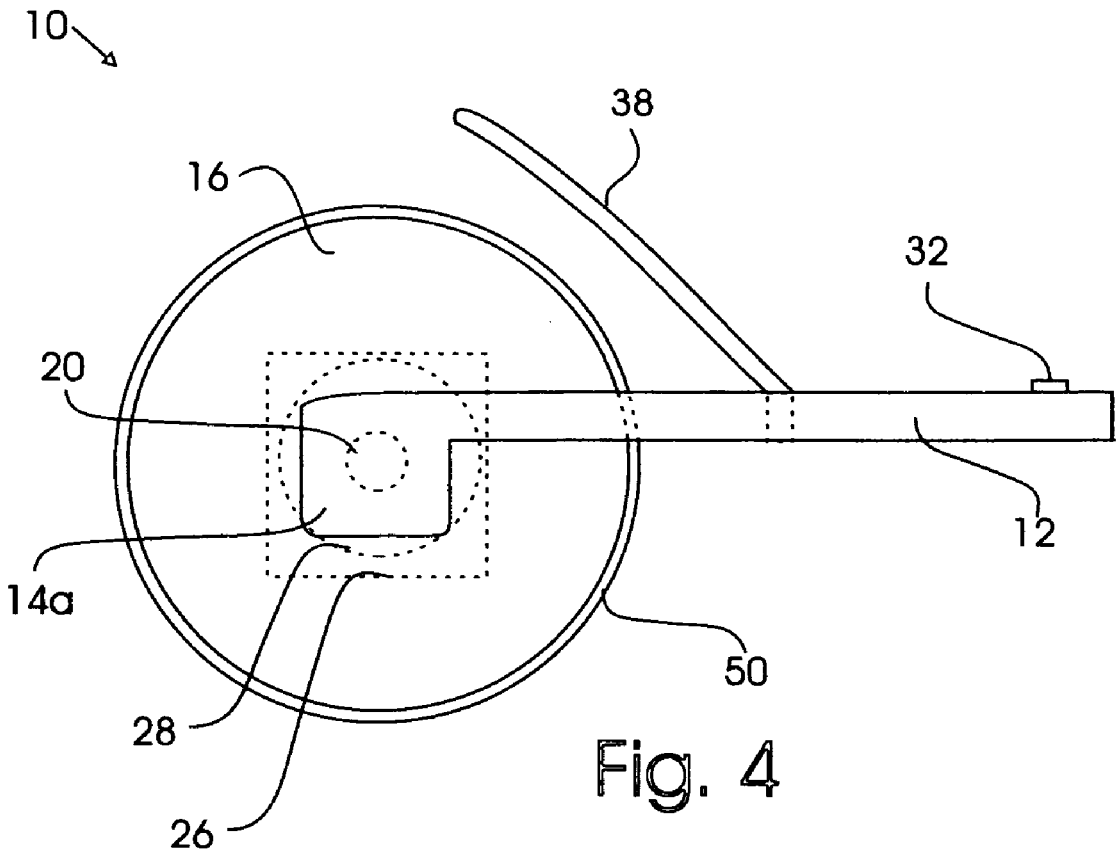
FIG. 4 is side view of the altered embodiment of the present invention shown in FIG. 3.

It is noted that the location of the motor can be along any area of the frame. An example of an alteration for this configuration is shown in FIGS. 3-4. As seen in these figures, the motor unit 26 is located next to the cylindrical body 16. This will allow for the drive shall of the motor 28 to be in direct contact with the axle 20 of the cylindrical body 16. In this type of configuration, the axle 20 includes a receiving port 40 that will receive the drive shaft of the motor (illustrated but not labeled). Once the motor is activated, the drive shaft will rotate causing the axle to rotate, inherently providing for the rotation of the cylindrical body. Secured to the cylindrical body is a pad 50. The pad is fabricated from conventional material and will be discussed in further detail in FIGS. 8*a*-8*c*. The rotation occurs about a normally horizontal axis parallel to a normal direction of the desired surface to be buffed, polished, and cleaned or the like. Hence, the cylindrical body's annular outer surface will be in direct contact with the desired surface to be buffed. The cylindrical body will rotate about the axle causing the contact of the pad to occur horizontally to the desired surface. This outer surface will be centered on and turned radially about the axis of the cylinder. The axis being the axle of the cylindrical body.

As seen in these drawings, in FIGS. 3-4, like the first embodiment, the frame includes the U-shape configuration to provide for a first lower member 22*a* and outer parallel member 22*b* and 22*c*, respectfully.

Like the first embodiment for the frame, coupling the motor to the cylindrical body allows for it to rotate in a position that is parallel to the surface. Thereby preventing and/or eliminating swirl marks or wheel marks to occur. Activation is similar to the first embodiment, and thus includes a switch 32 that is located on the handle. This switch is in electrical communication with the motor unit 26. Thus the switch is coupled electrically and mechanically to the motor. This coupling occurs internally within the frame 12 of the present invention. For comfort for the user, the switch can be rearwardly located 14*b* on the frame. A variable control switch 34 can be located thereon for varying the speed of the rotation of the shaft of the motor, consequently altering the rotation of the cylindrical body. The speeds can be control via the switch 32 or optionally a dial or the like, as shown, can be used to control the speed of the motor. In the preferred embodiment, the power is activated by a switch and the variable speed control is operated via a dial device, as show.

Verbiage can be located on or near the switch/speed control for indicating its use and purpose. It is to be understood that the designed and configuration of the buttons and verbiage or designed can be altered and changed for aesthetic purposes.

For enhancing the present invention, as well as for increasing the safety of the unit, the present invention 10 can include a housing 36 for protecting the motor unit. In addition, as disclosed in the first embodiment, a splash guard 38 can be provided for preventing the user from being splashed. As indicated previously, the splash guard 38 can also be used to protect the surface which is being worked on.

Figure 7:
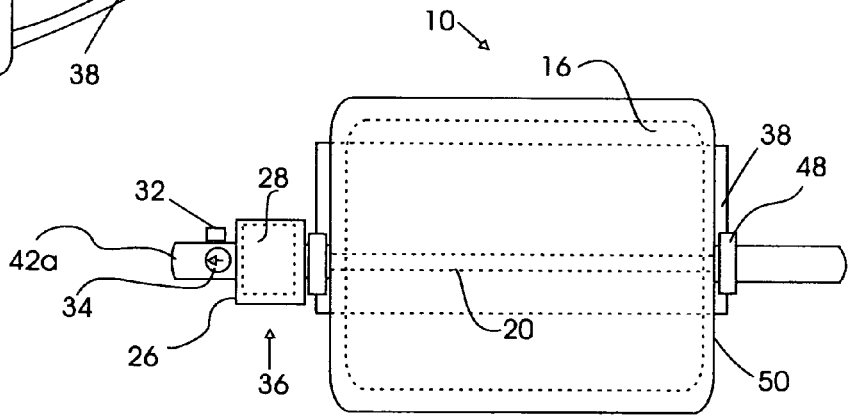
FIG. 7 is a bottom planar view of the elongated configuration for the frame of the buffer device having a splash guard located thereon.

The U-shape configuration for the frame can be eliminated and can include an elongated design. This configuration is illustrated in FIGS. 5-7. As seen, in this embodiment, the frame 12 includes a first side 42*a* and a second side 42*b*. Sandwiched between the first and second sides is the cylinder 16. Secured to this cylinder 16 is a pad 50. The pad is conventional material used for buffing and/or cleaning and will be discussed in further detail in FIGS. 8A-8C.

Secured to one side of the frame is the motor unit 26. This motor unit being in electrical and mechanical communication with the axle 20 of the cylindrical body. Thus when the motor unit is activated, the cylindrical body rotates and is in use. Rotation occurs as previous stated. Hence the rotation will occur about a normally horizontal axis parallel to the desired surface to be buffed, polished, and cleaned or the like. This arrangement of the motor unit with respect to its attachment to the cylindrical body is similar in design as disclosed in FIGS. 3 and 4.

Hence, the motor unit, like the previous embodiments, can include a housing 36 for protection. Located within the housing is a conventional motor 28 having a drive shaft, 44. The drive shaft 44 is in direct communication with the axle 20 of the cylinder 16. In order to provide for this configuration, one end of the frame includes a channel that enables the drive shaft to extend therethrough (illustrated in outline in FIG. 5). This drive shaft extends into a receiving means located in the cylinder 16, illustrated, but not labeled. Upon activation, the drive shaft 44 will rotate, causing the rotation of the cylinder, by way of the receiving means. The opposite side of the frame includes a receiving port 46 for receiving the axle of the cylindrical body.

The ends of the frame, 42*a* and 42*b*, extend outwardly to form an inherent handle. For added comfort, foam padding or the like can be added to the outer ends. The activation switch 32 and optionally speed variable controller 34 would be located in close proximity to the handles. The activation switch and speed variable controller, if used, would be in electrical and mechanical communication with the motor unit. This communication would be done in a conventional manner.

In this embodiment, the present invention could be enhanced by the use of a splash guard 38 shown in FIGS. 6 and 7. In this embodiment, the splash guard 38 would be attached to the first and second members 42*a* and 42*b* of the frame via an attaching member 48. This attaching member 48 would be secured to the outer ends of the shaft member. This attachment would be such that the cylindrical member could freely rotate about the ends of the splash guard, while the splash guard would not rotate nor move. The splash guard would inherently be located rearwardly with respect to the cylindrical member.

Secured to this cylindrical body 16, regardless of which configuration of frame that is being utilize, is a pad 50. The pad is fabricated from conventional material that is well known in the art. The type of material use for the pad 50 is dependent upon the process that is being performed. Thereby, the pad can be fabricated from polyester foam, ranging from 50 ppi (pores per inch) to over 100 ppi, hence allowing for the device to be used for finishing, polishing, or buffing. More specifically, for buffing, the material should preferably be between 50-60 pores per linear inch. For polishing, the material should preferably be between 60-80 pores per linear inch.

For finishing, the material should preferably be approximately 100 pores per linear inch.

Figure 8A:
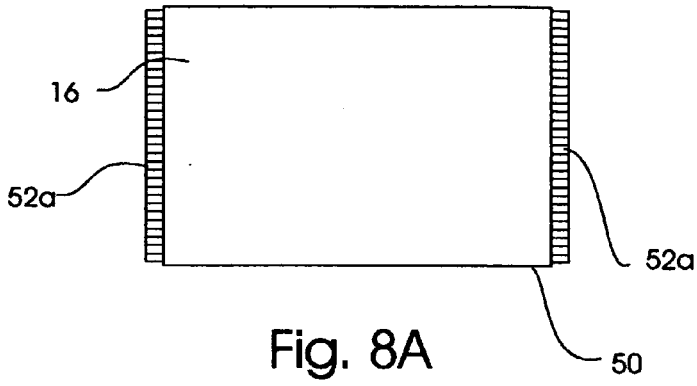
FIG. 8A is a top planar view of the first embodiment for the pad used with the cylinder of the buffer device of the present invention.

The pad 50 can include a plurality of embodiments. One embodiment for the pad 50 is shown in FIG. 8A. As seen in this embodiment, the pad 50 is cylindrical in shape and includes open outer ends. The shape inherently forms a sleeve-like configuration for the pad. This sleeve configuration will enable the pad to slide on the cylindrical body when desired so as to provide for the pad to be held frictionally on the cylindrical body. This pad will be fabricated from any desired material as defined above. In addition, the outer ends 52*a* can include a strip of material fabricated from a material different than the pad itself, such as an elastic type, consequently aiding in the removal and attachment of the pad to and from the cylinder.

For this configuration of the a sleeve like pad being designed to be removably secured to the cylindrical body, 16, then the cylindrical body is designed and configured to be removable secured to the frame. This type of securement that would be used in the present invention would be convention. For the embodiment shown in the figures a conventional method of the receiving ports would allow for the cylinder to snap and lock into place. Spring loaded pins can be used for added security.

Figure 8B:
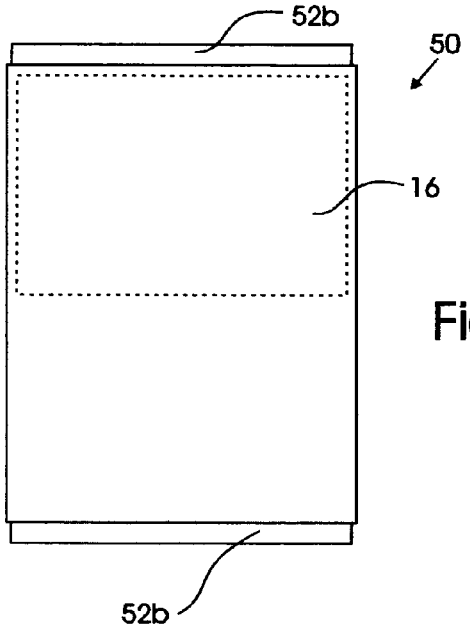
FIG. 8B is a top planar view of the second embodiment for the pad used with the cylinder of the buffer device of the present invention.

Alternatively, and as illustrated in FIG. 8B, the pad 50 can be rectangular in shape. This will render a device having opposite elongated ends, illustrated but not labeled. These ends will include a conventional removable corresponding attaching element 52*b*. Shown in the figure is the use of hook and loop material, such as the commercially known material Velcro. This will provide for the user to wrap the rectangular pad around the cylinder and secure it in a fixed position via the use of the attaching element. Once secured thereto, the present invention is ready for operation. In this embodiment the cylindrical body 16 can permanently or removably secured to the frame member.

Figure 8C:
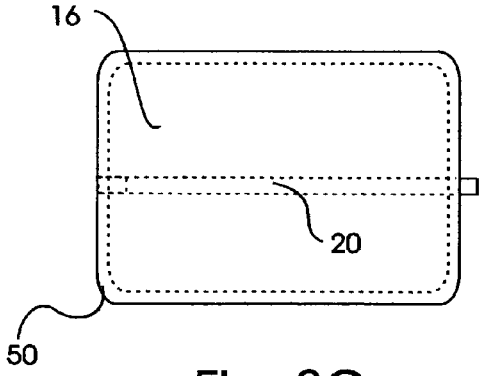
FIG. 8C is a top planar view of the second embodiment for the pad used with the cylinder of the buffer device of the present invention.

In yet another embodiment, shown in FIG. 8C, the pad 50 can be permanently secured to the cylindrical body 16. This configuration will provide for a device having disposable cylindrical pad members. The cylindrical pad member will be two layers. The first being the core or cylinder body and second layer being the pad. In this configuration, the particular material will be permanently located on the exterior of the cylindrical body.

In this configuration for the frame and cylindrical body, the cylindrical body will be removably secured thereto. This configuration is shown in FIG. 3. Conventional means will be used for removably securing the cylinder to the frame. Thereby, the cylinder member will have the central axle 20 and include the necessary receiving ports to enable adequate attachment of the cylinder to the desired frame.

Figure 9:
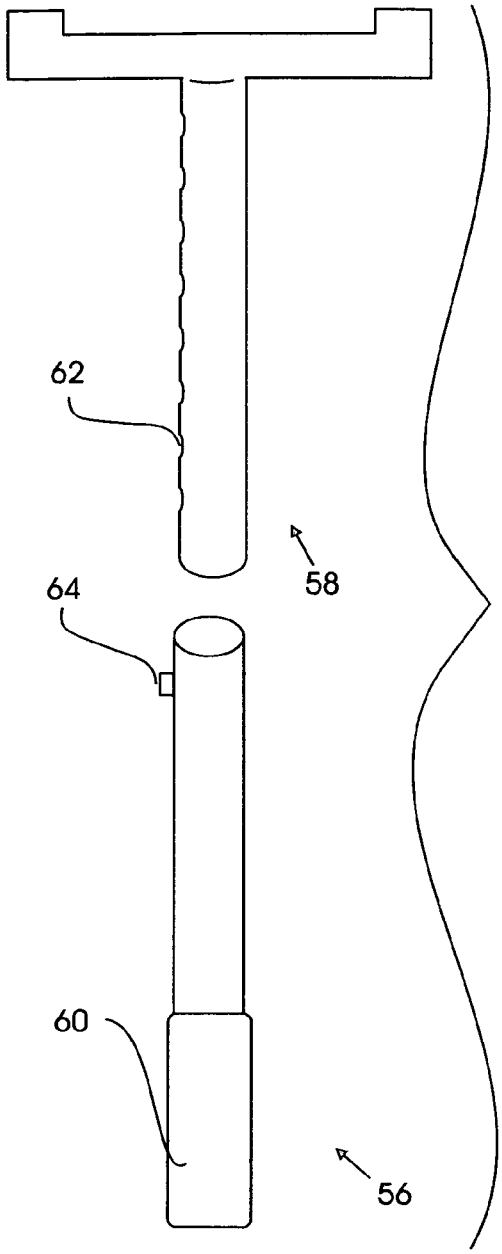
FIG. 9 is a side planar view of the height extension bar for the buffer device of the present invention.
Figure 10:
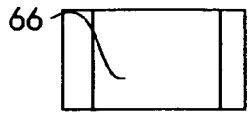
FIG. 10 is a top planar view of the cup member used in the height extension bar for the buffer device of the present invention.
Figure 11:
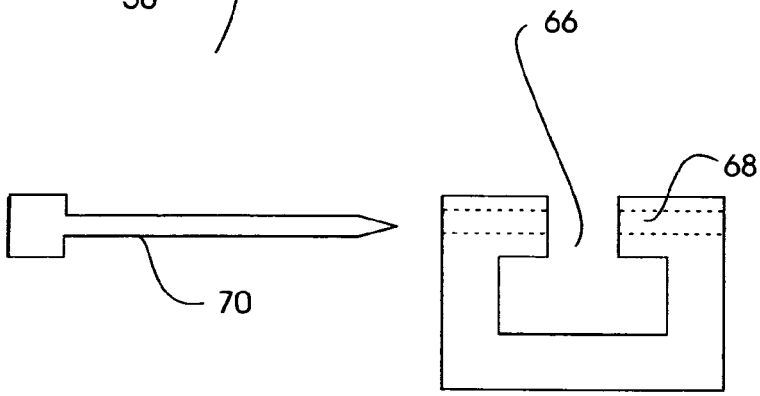
FIG. 11 is an enlarged side planar view of the cup member used in the height extension bar for the buffer device of the present invention.

Various features can be added to enhance the present invention. For example, removable length handles 54 can be used with the present invention, as seen in FIGS. 9-11. These figures illustrate another feature that can be used with the present invention for enhancing and providing a more user friendly product. As seen in the drawings, the removable length handles 54 include a lower portion 56 and an upper portion 58. The lower portion 56 being designed and configured to act as a holder/handle. The upper portion 58 being designed and configured to be removably secured to the frame. A height adjusting means is located on the upper and lower portions. Thereby the upper end of the lower portion 56 is received with the lower end of the upper portion 58. Hence, providing for the lower portion 56 and upper portion 58 to be hollow members.

The lower portion 56 is an elongated shaft that can include a padded area 60 located thereon, and as shown. The purpose of the padded area is for providing comfort for the user when utilizing the present invention. As seen, the upper end of the lower portion 56 and the lower end of the upper portion include the height adjusting means. This height adjusting means is conventional and as seen the lower end of the upper portion 58 includes a series of apertures 62 vertically disposed thereon. Located on the upper end of the lower portion 56 is a spring-loaded button 64. The button 64 being designed and configured to be removably secured within the desired aperture. Thus, in order to use this height adjusting means, the user depresses the spring-loaded button 64. This enables the lower portion 56 to be slideably located within the upper portion 58. Once the desired length is achieved, the spring-loaded button 64 emerges from the aperture of the desired location. This will provide for the elongated handle to be in a locked position.

As seen, the upper portion, 58 includes a pair of extension. Secured to each extension member is a C-shape member. The C-shape member including an open end 66 that will receive the frame and/or handle portion. The C-shape member will expand when receiving the frame portion and inherently snap into a lock position when located therein. This open end will receive a side of the frame member. Thereby, each side of the frame will be secured to the extension device, thus providing for a secured fit.

Alternatively, and for providing a more secured fit, the C-shape member can include flange portions. Thereby having a first side flange member and a second side flange member. Each side would have an aperture 68 for receiving a conventional locking device 70. In one embodiment, the locking device can be a threaded knob that will extend through each aperture of each flange. Once located therein, a threaded nut would lock the C-shape member to the desired frame portion.

It is noted that the method of receiving the frame member and its respective locking device can be altered and change in order to provide for a more ergonomically design and configuration.

While the invention has been particularly shown and described with reference to an embodiment thereof, it will be understood by those skilled in the art that various changes in form and detail may be made without departing from the spirit and scope of the invention.

I claim:

1. A hand-held buffing apparatus for buffing a desired surface, said hand held buffing apparatus comprising:

a substantially U-shaped frame having a first outer member parallel to a second outer member;

said first outer member and second outer member perpendicular to a normally horizontal axis;

said first outer member and second outer member secured to a lower member to form the substantially U-shaped frame;

a cylindrical body removably secured between the two outer members along the horizontal axis with an attaching means;

a motor being mechanically coupled to said cylindrical body for enabling said cylindrical body to rotate about said normally horizontal axis horizontally and parallel to said desired surface;

said motor being secured to said substantially U-shaped frame;

a first handle extending upward from said first outer member so that the first handle is located above the first outer member and the first handle forms a V-shape with the first outer member when looking at a side view of the hand-held buffing apparatus, thereby creating a first apex where said first handle meets said first outer member;

a second handle extending upward from said second outer member so that the second handle is located above the second outer member and the second handle forms a V-shape with the second outer member when looking at a side view of the hand-held buffing apparatus, thereby creating an second apex where said second handle meets said second outer member; and a third handle extending across a rear portion of the buffing apparatus from the first outer member to the second outer member.

2. The hand-held buffing apparatus of claim 1 wherein:

said frame is an elongated shaft member and said elongated shaft member is hollow and houses said motor.

3. The hand-held buffing apparatus of claim 1 wherein:

said cylindrical body further comprises a core and a pad located on the core.

4. The hand-held buffing apparatus of claim 3 wherein:

said pad is a buffing pad.

5. The hand-held buffing apparatus of claim 3 wherein:

said pad is made of foam.

6. The hand-held buffing apparatus of claim 3 wherein:

said pad is a brush.

7. The hand-held buffing apparatus of claim 1 further comprising:

a bonnet located on the cylindrical body.

8. The hand-held buffing apparatus of claim 1 further comprising:

a splash guard extending upward from said frame and partially over said cylindrical body.

9. The hand-held buffing apparatus of claim 1 further comprising: an activation switch for activating and deactivating said motor.

10. The hand-held buffing apparatus of claim 1 further comprising:

a variable speed dial for enabling speed rotation control of said cylindrical body.

11. The hand-held buffing apparatus of claim 1 further comprising:

a height extension bar removably secured to the frame.

12. The hand-held buffing apparatus of claim 11 wherein:

said height extension bar further comprises electrical communication between the height extension bar and the motor.

13. The hand-held buffing apparatus of claim 12 wherein:

said height extension bar further comprises a switch for activating and deactivating the motor.

14. The hand-held buffing apparatus of claim 13 wherein:

said frame forms a substantially U-shaped configuration.

15. A hand-held buffing apparatus for buffing a desired surface, said hand held buffing apparatus comprising:

a substantially U-shaped frame having a first outer member parallel to a second outer member;

said first outer member and second outer member perpendicular to a normally horizontal axis:

said first outer member and second outer member secured to a lower member to form the substantially U-shaped frame;

a cylindrical body removably secured between the two outer members along the horizontal axis with an attaching means;

said cylindrical body having a core and a pad located on the core;

a motor being mechanically coupled to said cylindrical body for enabling said cylindrical body to rotate about said normally horizontal axis horizontally and parallel to said desired surface;

said motor being secured to said substantially U-shaped frame;

a first handle extending upward from said first outer member so that the first handle is located above the first outer member and the first handle forms a V-shape with the first outer member when looking at a side view of the hand-held buffing apparatus, thereby creating a first apex where said first handle meets said first outer member;

a second handle extending upward from said second outer member so that the second handle is located above the second outer member and the second handle forms a V-shape with the second outer member when looking at a side view of the hand-held buffing apparatus, thereby creating an second apex where said second handle meets said second outer member; and a third handle extending from said first apex to said second apex across a rear portion of the hand-held buffing apparatus.

16. The hand-held buffing apparatus of claim 15 wherein:

said pad is a buffing pad.

17. The hand-held buffing apparatus of claim 15 wherein:

said pad is made of foam.

18. The hand-held buffing apparatus of claim 15 further comprising:

a bonnet located on the cylindrical body.

19. The hand-held buffing apparatus of claim 15 further comprising:

a splash guard extending upward from said frame and partially over said cylindrical body.

20. A hand-held buffing apparatus for buffing a desired surface, said hand held buffing apparatus comprising:

a substantially U-shaped frame having a first outer member parallel to a second outer member;

said first outer member and second outer member perpendicular to a normally horizontal axis;

said first outer member and second outer member secured to a lower member to form the substantially U-shaped frame;

a cylindrical body removably secured between the two outer members along the horizontal axis with an attaching means;

said cylindrical body having a core and a pad located on the core;

a motor being mechanically coupled to said cylindrical body for enabling said cylindrical body to rotate about said normally horizontal axis horizontally and parallel to said desired surface;

said motor being secured to said substantially U-shaped frame;

a first handle only attached to the first outer member at one end of the first handle, said first handle extending upward from said first outer member so that the first handle is located above the first outer member and the first handle forms a V-shape with the first outer member when looking at a side view of the hand-held buffing apparatus, thereby creating a first apex where said first handle meets said first outer member;

a second handle only attached to the second outer member at one end of the second handle, said second handle extending upward from said second outer member so that the second handle is located above the second outer member and the second handle forms a V-shape with the second outer member when looking at a side view of the hand-held buffing apparatus, thereby creating an second apex where said second handle meets said second outer member; and a third handle extending from said first apex to said second apex across a rear portion of the hand-held buffing apparatus.

* * * * *